US005749824A

United States Patent [19]

Guth

[11] Patent Number: 5,749,824

[45] Date of Patent: May 12, 1998

[54] CONVERSION MACHINE LOADER AND METHOD

[75] Inventor: Paul J. Guth, Beachwood, Ohio

[73] Assignee: Ranpak Corp., Concord Township, Ohio

[21] Appl. No.: 708,735

[22] Filed: Sep. 5, 1996

[51] Int. Cl.[6] ..... B31F 5/02; B31F 7/00

[52] U.S. Cl. ..... 493/464; 493/268; 493/438; 493/439; 493/967

[58] Field of Search ..... 493/268, 405, 493/458, 439, 446, 455, 464, 967

[56] References Cited

U.S. PATENT DOCUMENTS

| | | | |
|---|---|---|---|
| 1,371,349 | 3/1921 | Brownlow . | |
| 3,799,039 | 3/1974 | Johnson . | |
| 4,650,456 | 3/1987 | Armington | 493/464 |
| 5,131,903 | 7/1992 | Levine | 493/464 |
| 5,322,477 | 6/1994 | Armington et al. . | |
| 5,630,781 | 5/1997 | Hubbard | 493/446 |

FOREIGN PATENT DOCUMENTS

| | | |
|---|---|---|
| 0523982 | 6/1992 | European Pat. Off. . |
| 9531296 | 11/1995 | WIPO . |
| 9603273 | 2/1996 | WIPO . |

*Primary Examiner*—Jack W. Lavinder
*Assistant Examiner*—Christopher W. Day
*Attorney, Agent, or Firm*—Renner, Otto, Boisselle & Sklar, P.L.L.

[57] ABSTRACT

A loading device and method for loading sheet-like stock material in a cushioning conversion machine. The loading device comprises an elongated threading member having an end portion dimensioned to pass through the stock material path of the cushioning conversion machine and at least one clip or other attachment device proximate an end of the threading member for attaching the stock material to the threading member. After attaching a leading end of the stock material to the loading device, the loading device is advanced through the cushioning conversion machine until the leading end of the stock material exits the downstream end of the machine.

21 Claims, 9 Drawing Sheets

CONVERSION MACHINE LOADER AND METHOD

FIELD OF THE INVENTION

The herein described invention relates generally to a cushioning conversion machine and method and, more particularly, to a device and method for loading sheet-like stock material into a cushioning conversion machine.

BACKGROUND OF THE INVENTION

In the process of shipping an item from one location to another, a protective packaging material is typically placed in the shipping case, or box, to fill any voids and/or to cushion the item during the shipping process. Plastic foam peanuts and plastic bubble pack are two types of conventionally used packaging materials. These plastic materials, however, although performing acceptably in many packaging applications, are not without disadvantages. For example, one drawback of plastic bubble film is that it usually includes a polyvinylidene chloride coating which prevents the plastic film from being safely incinerated thereby creating disposal difficulties for some industries. Additionally, both the plastic foam peanuts and the plastic bubble pack have a tendency to generate a charge of static electricity which attracts dust from the surrounding packaging site. Furthermore, these plastic materials sometimes themselves produce a significant amount of packaging "lint." Such dust and lint particles are generally undesirable and may even be destructive to sensitive merchandise such as electronics or medical equipment.

However, perhaps the most serious drawback of plastic bubble wrap and/or plastic foam peanuts is their effect on our environment. Quite simply, these packaging materials are not biodegradable and thus they cannot avoid further multiplying our planet's already critical waste disposal problems. The non-biodegradability of these packaging materials has become increasingly important as more industries adopt increasingly progressive policies of environmental responsibility.

These and other disadvantages of conventional plastic packaging materials have made paper protective packaging material a very popular alternative. Paper is biodegradable, recyclable and composed of a renewable resource, thereby making it an environmentally responsible choice for conscientious industries. Additionally, paper may be safely incinerated by the recipients of the products. Furthermore, paper protective packaging material is particularly advantageous for use with particle-sensitive merchandise, as its clean dust-free surface is resistant to static cling.

While paper in sheet form could possibly be used as a protective packaging material, it is usually preferable to convert the sheets of paper into a relatively low density pad-like cushioning dunnage product. This conversion may be accomplished by a cushioning conversion machine, such as the machine disclosed in the published PCT Application No. PCT/US95/09274 (International Publication No. WO 96/03273), which is owned by the assignee of the present application.

In such conversion machine, the stock material constituting the starting material for the conversion process will usually be composed of one or more plies of a sheet-like material that passes through a forming device and a feeding device that cooperate to convert a continuous web of the sheet-like stock material (either single-ply or multi-ply) into a three dimensional cushioning product, or pad. The forming device folds, or rolls, the lateral edges of the sheet-like stock material inward on itself to form a strip having a width substantially less than the width of the stock material. The feeding device, including a pair of rotating coining gears, advances the stock material through the forming device and also functions as a crumpling device and a connecting (or assembling) device. The cushioning conversion machine also includes a severing assembly for severing the strip into sections of desired length.

In preparation for operation of the machine, the machine is loaded with stock material. Stock material, in particular multi-ply (usually two or three ply) Kraft paper in roll form, is supported on a stock roll holder for feeding into the machine. The stock material is threaded through the forming assembly, typically by folding the leading portion of the stock material in a triangular-like fashion and manually pushing this leading portion through the forming assembly (e.g., a forming frame and a converging chute) so that the "point" of the triangle is positioned for engagement by the coining gears of the feeding device. During the threading procedure, a cover of the machine housing is removed (or otherwise opened) to allow access to the forming assembly for loading the paper into the machine.

After the stock material has been threaded through the forming assembly and its leading end positioned to be engaged by the coining gears of the feeding device, the cover of the machine housing is closed to actuate an interlock switch which permits operation of the feeding device. With the cover in place, the feeding device is operated to rotate the coining gears thereby to engage and advance the stock material through the machine. Usually, the leading end of the stock material will be engaged by the rotating coining gears and fed through the machine. Occasionally, the stock material will not have been positioned close enough to the feeding device such that it is not caught by the coining gears (or other driving component of other types of feeding devices) when the latter are rotated, thereby presenting a false load situation or problem. This problem is more prevalent when the machine is oriented vertically such that the stock material travels vertically upwardly through the machine, as jostling and gravity may cause the leading end of the stock material to drop away from the coining gears of the feeding device while the cover is being closed. If this occurs, the cover must be removed and the stock material repositioned for engagement by the coining gears, often by jamming the leading end of the stock material against the meshed teeth of the coining gears.

Efforts have been made in the prior art for facilitating the loading operation in respect of the above and other cushioning conversion machines. It would be desirable, however, to provide lower cost and effective devices and methods for loading cushioning conversion machines.

SUMMARY OF THE INVENTION

The present invention provides a loading device and method for loading a cushioning conversion machine that eliminates the need to manually push the stock material through the forming assembly of the machine, and thus overcomes the aforesaid false load problem. The loading device comprises an elongated threading or leader member, preferably in the form of a starter strip or snake, having an end portion dimensioned to pass through the cushioning conversion machine, and at least one attachment device proximate an end of the threading member for attaching the threading member to the stock material.

In one embodiment, the loading device is inserted into a downstream end of the machine for a distance sufficient to locate the attachment device at an upstream end of the forming assembly. The leading end of the stock material is attached to the loading device by the attachment device and the machine is operated while the loading device is moved forwardly through the machine to draw the leading end of the stock material into the feeding device. After the leading end of the stock material emerges from the downstream end of the machine, the loading device is detached. As will be appreciated, threading of the stock material through the machine is assured, even after closing a cover of the machine's housing as may be necessary to enable operation of the machine's feeding device. In one embodiment the loading device is manually moved whereas in another embodiment the loading device is driven by the feeding device.

In still another embodiment, the loading device is fed into the upstream end of the machine sufficiently to position the leading end thereof for engagement by the feeding device. After the leading end of the stock material is attached to the trailing end of the loading device, the machine is operated and the loading device advanced forwardly to draw the leading end of the stock material into the feeding device.

Accordingly, a method of loading the stock material into a cushioning conversion machine in accordance with the invention comprises the steps of attaching a leading end of the stock material to a loading device, inserting the loading device into the cushioning conversion machine, and advancing the loading device through the machine to draw the leading end of the stock material into the feeding device. A loading device may first be inserted into the downstream end of the machine to position the upstream end thereof at an upstream end of the forming assembly for attachment of the stock material thereto or, alternatively, a loading device may be inserted into the upstream end of the forming assembly of the machine. In either methodology, the loading device may be engaged by the feeding device for advancement through the feeding device (or more particularly a feeding/connecting assembly) of the machine.

The foregoing and other features of the invention are hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE INVENTION

Figure 1:
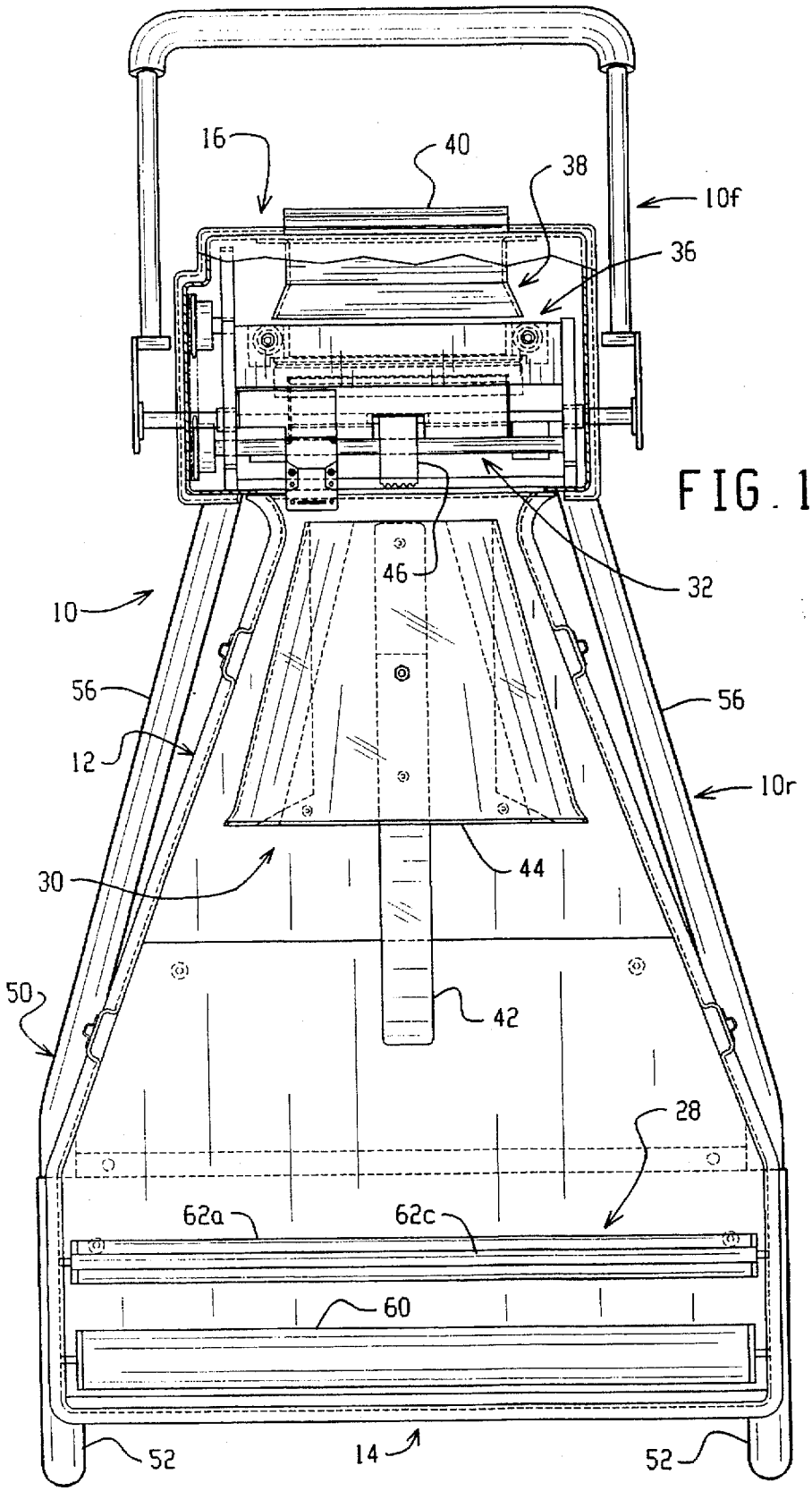
FIG. 1 is a front elevational view of a cushioning conversion machine including head (top) and former (bottom) modules with the cover of the housing of the former module removed to show internal components.
Figure 2:
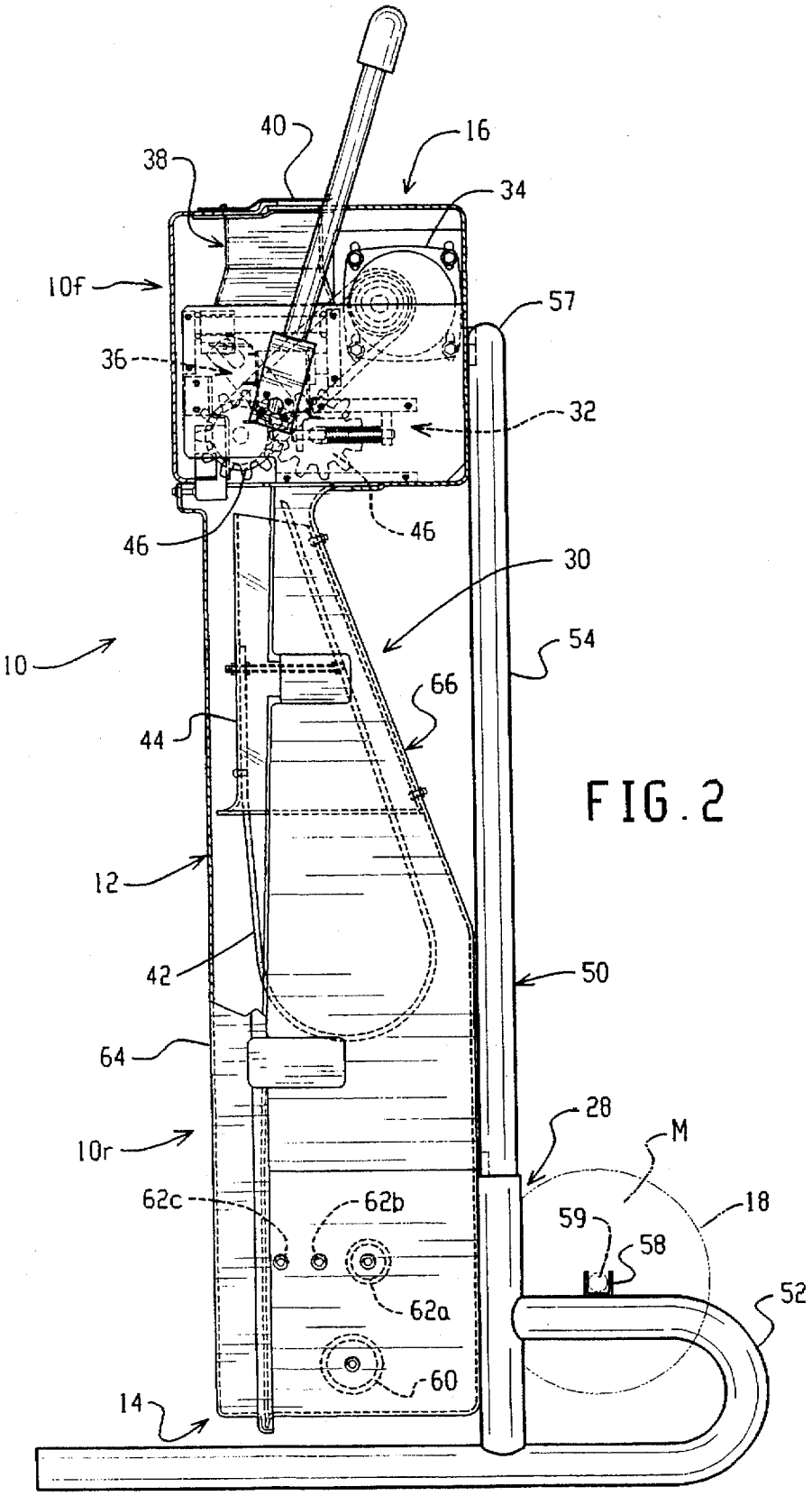
FIG. 2 is a side elevational view of the machine of FIG. 1, with portions of the machine housing broken away to show internal components.

Referring now to the drawings in detail and initially to FIGS. 1 and 2, an exemplary cushioning conversion machine is designated generally by reference numeral 10. The machine 10 converts a sheet-like stock material, such as one or more layers of recyclable and reusable Kraft paper, into a dunnage product having lateral pillow-like portions separated by a relatively thin central band. The dunnage product is used as an environmentally responsible protective packaging material typically used during shipping.

The illustrated machine 10 is of a modular construction including a head or downstream module **10*f* and a former or upstream module 10*r*. The references herein to downstream and upstream are made in relation to the movement direction of the stock material M (FIG. 2**). It will also be appreciated that references to top and bottom, upper and lower, etc. are made in relation to the illustrated orientation of the machine to describe positional relationships between components of the machine and not by way of limitation, unless so indicated.

The modular construction of the machine 10 and components thereof are described in detail in the aforesaid published PCT Application No. PCT/US95/09274 (International Publication No. WO 96/03273), which is hereby incorporated herein by reference in its entirety. However, for purposes of describing preferred loading devices and methods according to the present invention, the machine 10 may be viewed as a singular unit with pertinent portions thereof hereinafter described as necessary to gain an understanding of the present invention and its application to the machine 10 as well as to other types of cushioning conversion machines.

With the foregoing in mind, the machine 10 includes a housing 12 (composed of the separate housings of the head and former units **10*f* and 10*r*), having an upstream end 14 and a downstream end 16. The stock material M from which the packaging material is made is supplied from a source, preferably in the form of a stock roll 18 (FIG. 2), near the upstream end 14 of the machine 10. The paper passes through the machine 10 and emerges at the downstream end 16. The route that the stock material takes as it moves from the upstream end 14 to the downstream end 16** is herein referred to as the stock material path.

The machine 10 further includes a stock supply assembly 28, a forming assembly 30, a feeding/connecting assembly 32 powered by a motor 34 and a severing assembly 36 all of which are mounted to and/or in the housing 12. A post-severing guide assembly 38 is located downstream of the severing assembly 36 and at the downstream end 16 of the machine 10. The housing 12 Is provided with a one-way flapper door 40 which covers the downstream outlet opening of the machine 10. As shown, the flapper door 40 is mounted to the housing 12 such that when in a closed position, the flapper door 40 spans and thus closes the outlet opening to prevent foreign objects from entering through the opening and interfering with the severing assembly 36 located immediately inwardly of the opening. The door 40 will be pushed open as dunnage product advances through the outlet opening.

The forming assembly 30 includes a forming member 42 and a converging shaping chute 44. The forming member and shaping chute cooperate to cause an inward rolling or folding of the lateral edges of the sheet-like stock material drawn therethrough to form a continuous strip of cushioning having lateral pillow-like portions. The stock material is drawn through the forming assembly by cooperating and opposed rotating feed elements, particularly coining gears 46, of the feeding/connecting assembly 32 that are rotatably driven by the motor 34, preferably an electric motor.

The feeding/connecting assembly 32 of the illustrated conversion machine performs dual functions in the operation of the machine 10. One function is a "feeding" function, the coining gears 46 pulling the stock material M from a source thereof and then through the forming assembly 30. The material is then discharged by the feeding/connecting assembly 32 through the outlet opening at the downstream end 16 of the housing 12.

The second function performed by the feeding/connecting assembly 32 is a connecting function. Preferably, the feeding/connecting assembly 32 connects the continuous strip by the two opposing gears coining and preferably perforating the formed stock material along a central band to form a connected strip. As the connected strip travels downstream from the feeding/connecting assembly 32 it passes through the severing assembly 36 which cuts the strip into sections of a desired length. These cut sections then travel through the post-severing guide assembly 38 which may include a converging portion and rectangular tunnel portion. Although the rotating feed elements 46 are referred to as gears or coining gears, this reference is intended to encompass any other type of paired rotating elements between which the stock material may be engaged for continued passage therebetween.

The stock supply assembly 28 may include or have associated therewith a stock dispenser onto which a stock roll can be loaded and then supported for paying off stock material during operation of the machine 10. As will be appreciated, various forms of stock dispensers may be used. For example, the stock dispenser may be a cart onto which a roll of stock material may loaded and then the cart rolled into position for supplying stock material to the downstream components of the machine 10.

In the illustrated embodiment, the machine 10 is mounted on a stand 50. The stand 50 comprises a pair of J-shaped portions forming by a pair of feet 52, and an upright portion 54 to where the machine is mounted. As shown, the upright portion 54 of the stand 50 generally has an inverted U-shape having a pair of legs 56 and a connecting portion 57. The lower ends of the legs are telescoped into respective horizontal tubes formed integrally in the feet 52. The end portions of the legs may be fixed in the tubes by suitable means such as by welding or they may be inserted with a slip fit such that the upper frame may be conveniently separated from the feet 52. If desired, each foot 52 may be equipped with wheels such as casters for rolling on a floor. Each foot 52 also may include a respective one of a pair of cradles 58 for receiving the ends of a spindle 59 or other stock roller holder.

The stock supply assembly 28 preferably includes, in a known manner, a constant entry roller 60 and separators 62*a–c*, the former providing a constant point of entry for the stock material regardless of the diameter of the stock roll 18 and the latter serving to separate the plies or layers of stock material prior to passage to the forming assembly 30. Reference may be had to U.S. Pat. Nos. 4,026,198, 4,650,456, 4,750,896, 5,123,889 and 5,322,477 for further details of the illustrated stock material supply, as well as for examples of alternative stock material supply arrangements.

Heretofore, the leading portion of the stock material M coming from the separators 62 was manually threaded through the forming assembly 30. This manual threading typically entailed folding the leading portion of the stock material in a triangular-like fashion and manually pushing this leading portion through the forming assembly 30 (i.e., the forming member 42 and the converging shaping chute 44) so that the "point" of the triangle was positioned between the gears 46 of the feeding/connecting assembly 32. Although effective, this task was somewhat tedious and required some skill to properly position the leading portion of the stock material in the nip or bite of the feeding/connecting gears 46. In addition, this manual threading was done with the cover 64 of the housing 66 of the former unit 10*r* opened, for example removed, to gain access to the interior components of the former unit 10*r*. if the an interlock was provided to prevent operation of the machine if the cover 64 is removed, then the cover 64 had to be replaced before the feed/connecting assembly could be operated to rotate the gears 46.

As above mentioned, usually the leading end of the stock material would be engaged by the rotating coining gears and fed through the machine. Occasionally, the stock material would not have been positioned close enough to the feeding device such that it was not caught by the coining gears when the latter are rotated, thereby presenting a false load situation or problem. This problem is more prevalent when the machine is oriented vertically (as shown) such that the stock material travels vertically upwardly through the machine, as jostling and gravity may cause the leading end of the stock material to drop away from the coining gears of the feeding device while the cover is being closed. If this occurred, the cover 64 would have to be removed and the stock material repositioned for engagement by the coining gears 46, often by jamming the leading end of the stock material against the meshed teeth of the coining gears.

Figure 3:
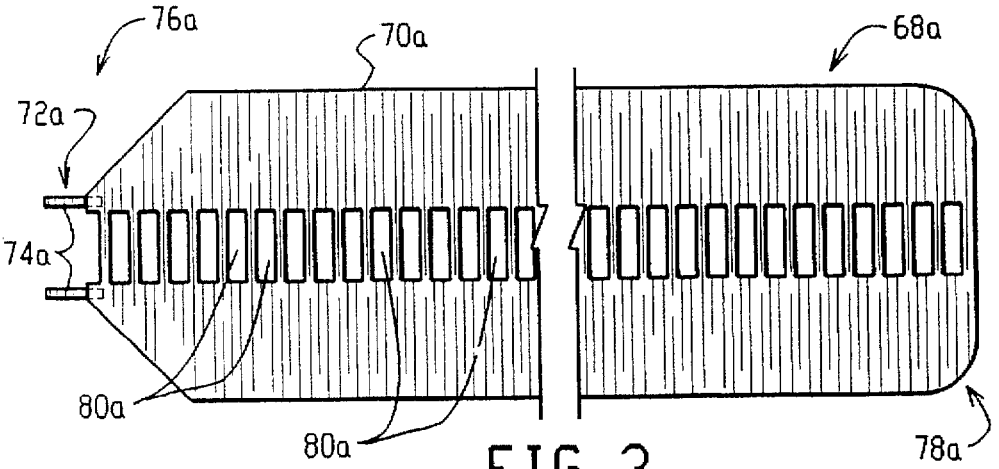
FIG. 3 is a plan view of one embodiment of loading device according to the present invention.
Figure 4:
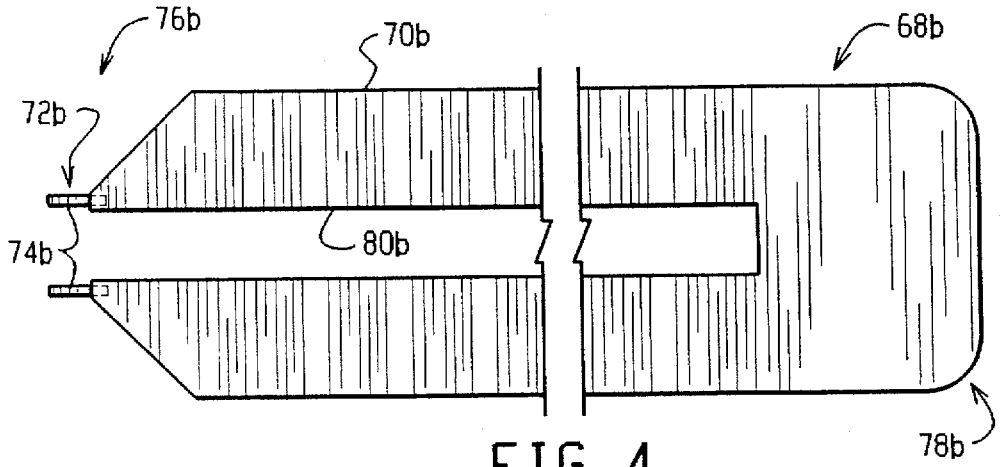
FIG. 4 is a plan view of another embodiment of loading device according to the present invention.
Figure 5:
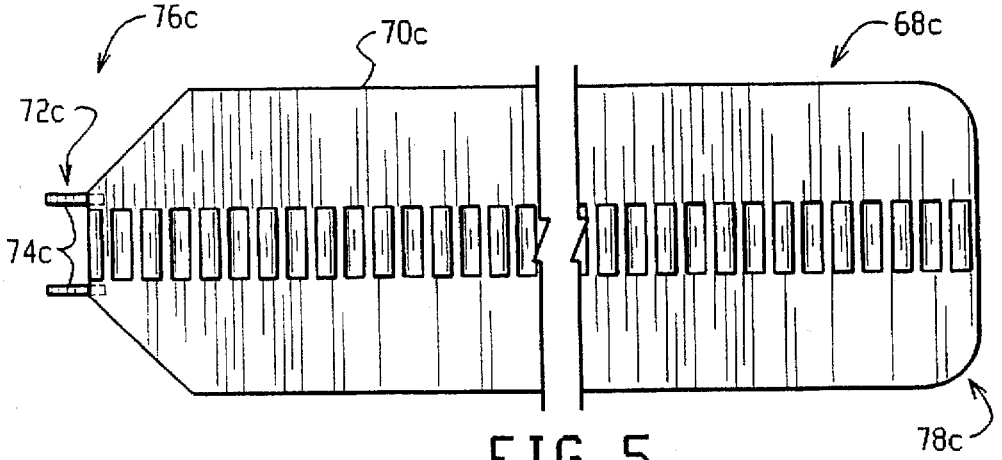
FIG. 5 is a plan view of still another embodiment of loading device according to the present invention.

The present invention provides a loading device that facilitates this threading operation. Several alternative embodiments of a loading device according to the invention are illustrated in FIGS. 3–5. Each loading device 68*a*, 68*b*, 68*c* includes a threading member 70*a*, 70*b*, 70*c* and an attachment device 72*a*, 72*b*, 72*c* at one end of the threading member for effecting attachment of a leading end of the stock material to the threading member. Any suitable attachment device may be used, for example clips, tape, hooks, etc. In a preferred embodiment, a pair of clips 74*a*, 74*b*, 74*c* are provided proximate an attachment or clip end 76*a*, 76*b*, 76*c* of the threading member opposite a handle end 78*a*, 78*b*, 78*c* of the threading member.

Each threading member 70*a*, 70*b*, 70*c* shown in FIGS. 3–5 preferably is in the form of a thin strip of a flexible material such as plastic sheet or sheet metal that is flexible in a lateral direction but stiff in its longitudinal direction. Each threading member is of sufficient length so that it can at least extend from the upstream end of the converging shaping chute 44 past the feeding/connecting assembly 32 (See FIGS. 8 and 9). Also, each threading member has a width less than the paper path through the machine and, in particular, less than the interior passage width of the shaping chute 44 and the post-severing guide assembly 38, such that the threading member can pass freely along the paper path in the hereinafter described manner. Preferably, the threading member has a width approximately the same as width dimension of the dunnage product produced by the machine 10. As is also preferred, each threading member is symmetrical with respect to its longitudinal center axis and the clips 74*a*, 74*b*, 74*c* are equally spaced from the longitudinal center axis at opposite sides thereof by an amount sufficient to clear the gears 46 when the threading member is fed through the feeding/connecting assembly 32 in the hereinafter described manner. Additionally, each threading member may have a tapered attachment end 76*a*, 76*b*, 76*c* to facilitate guiding through interior components of the machine.

As shown in FIG. 3, the threading member 70*a*, has extending along the length thereof, a row of slots 80*a* which may be rectangular as shown or of any other desired shape. The slots 80*a* are preferably centered with respect to the longitudinal center axis of the threading member and are spaced apart at one half the pitch spacing of the teeth of the gears 46 of the feeding/connecting assembly 32. Also, the slots are dimensioned to receive the teeth of the gears therein when the threading member is fed between the gears. Accordingly, the threading member 70*a* can be inserted into the feeding/connecting assembly and the gears rotated progressively to engage the teeth in the slots for advancing the threading member in either direction depending on the rotation direction of the gears.

Figure 6:
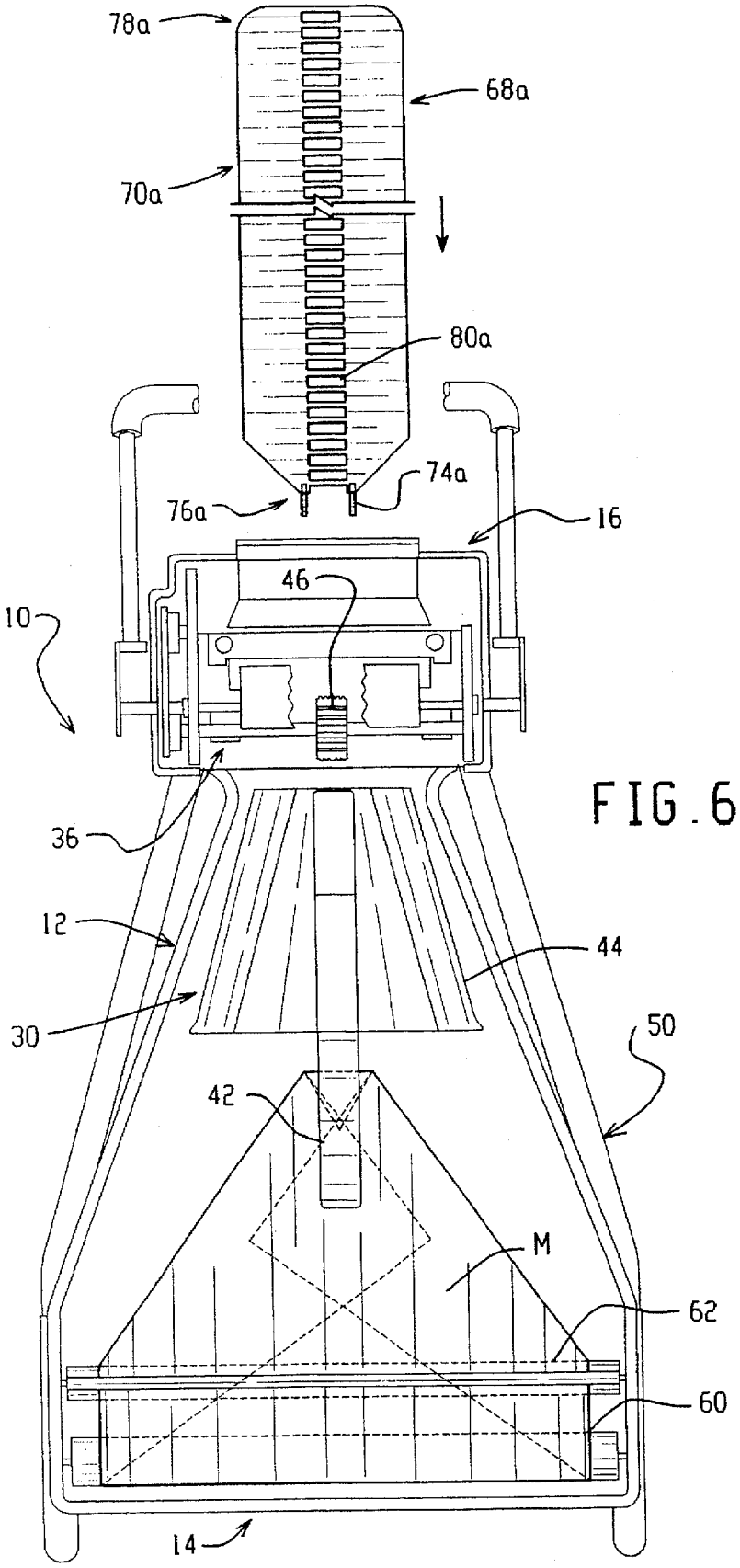
FIGS. 6 through 11 are front and side elevational views of the cushioning conversion machine and loading device, sequentially illustrating the manner in which stock material is loaded into the machine in accordance with the invention.
Figure 7:
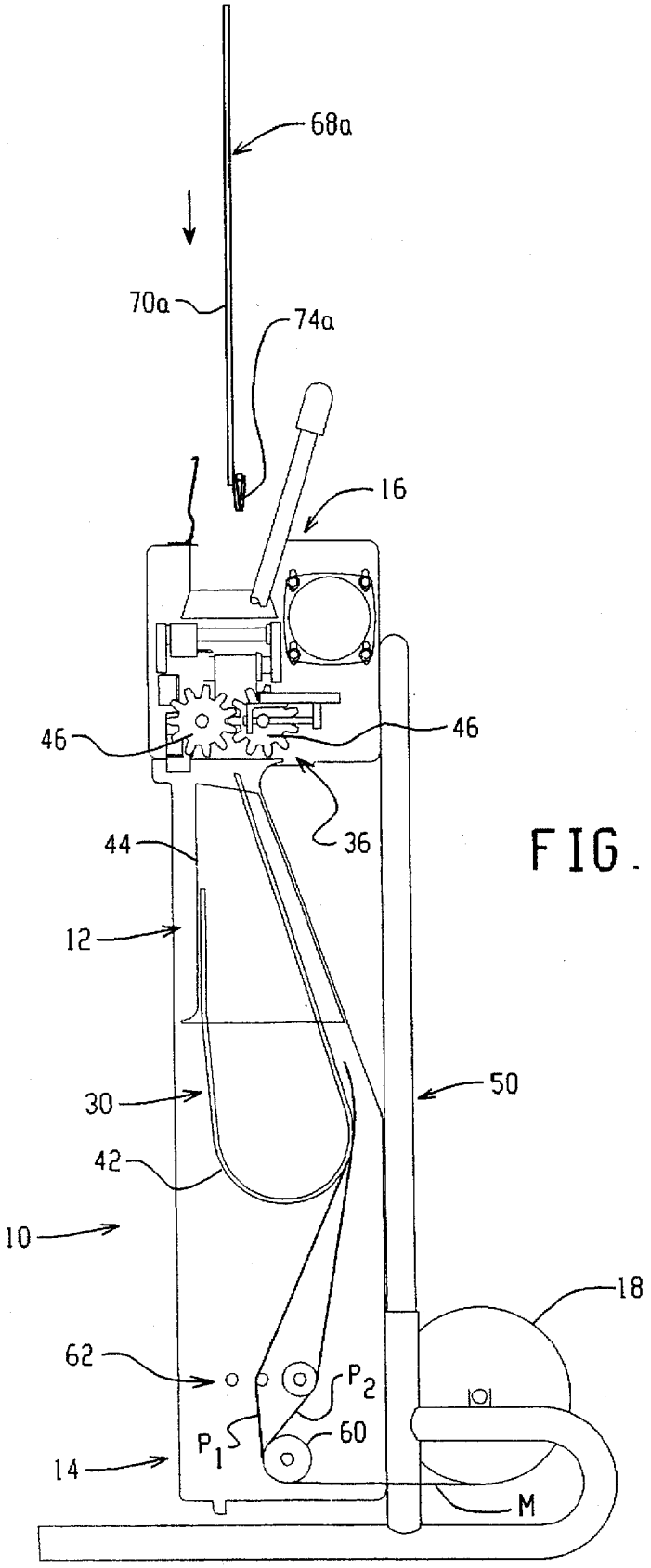
Figure 8:
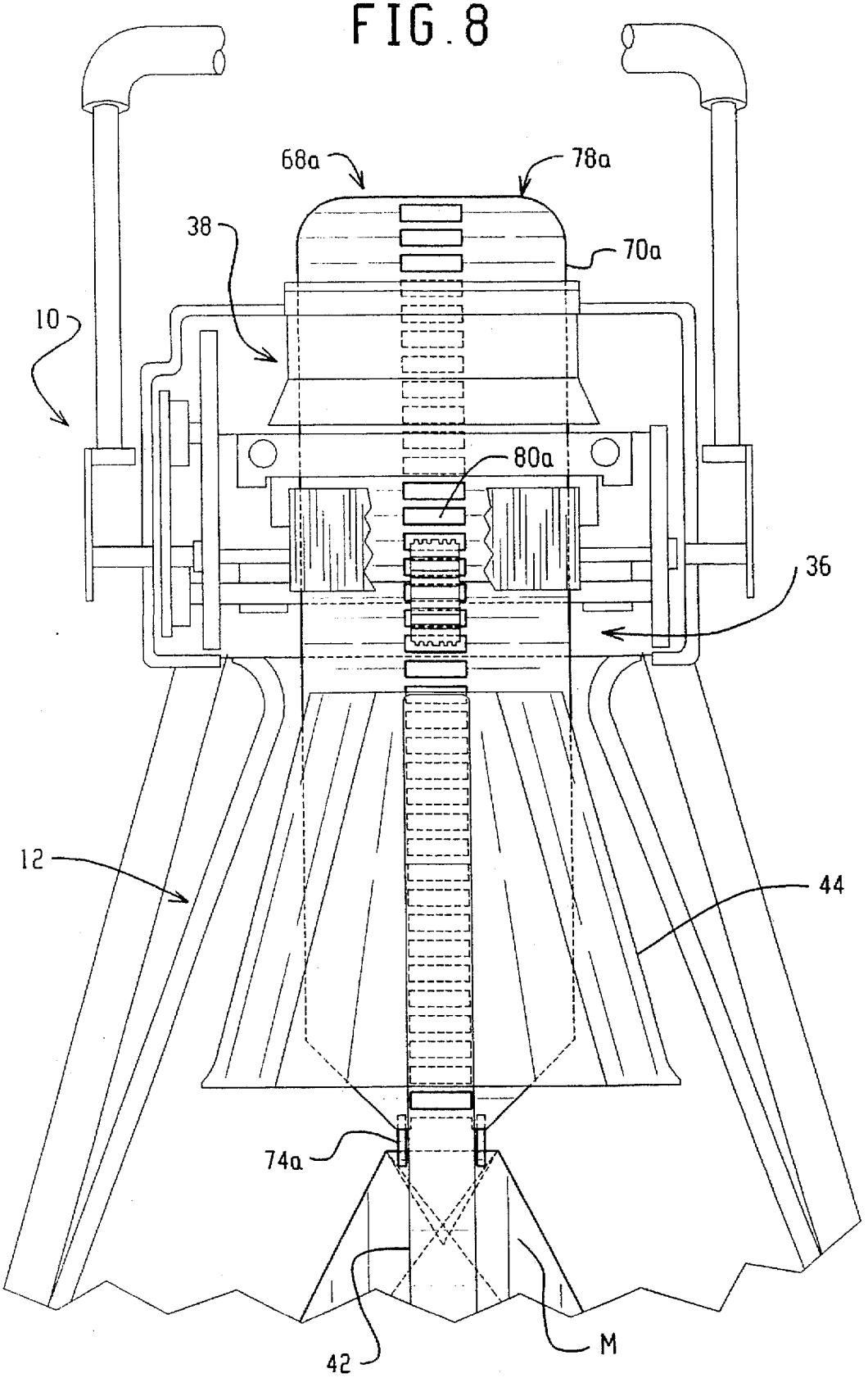
Figure 9:
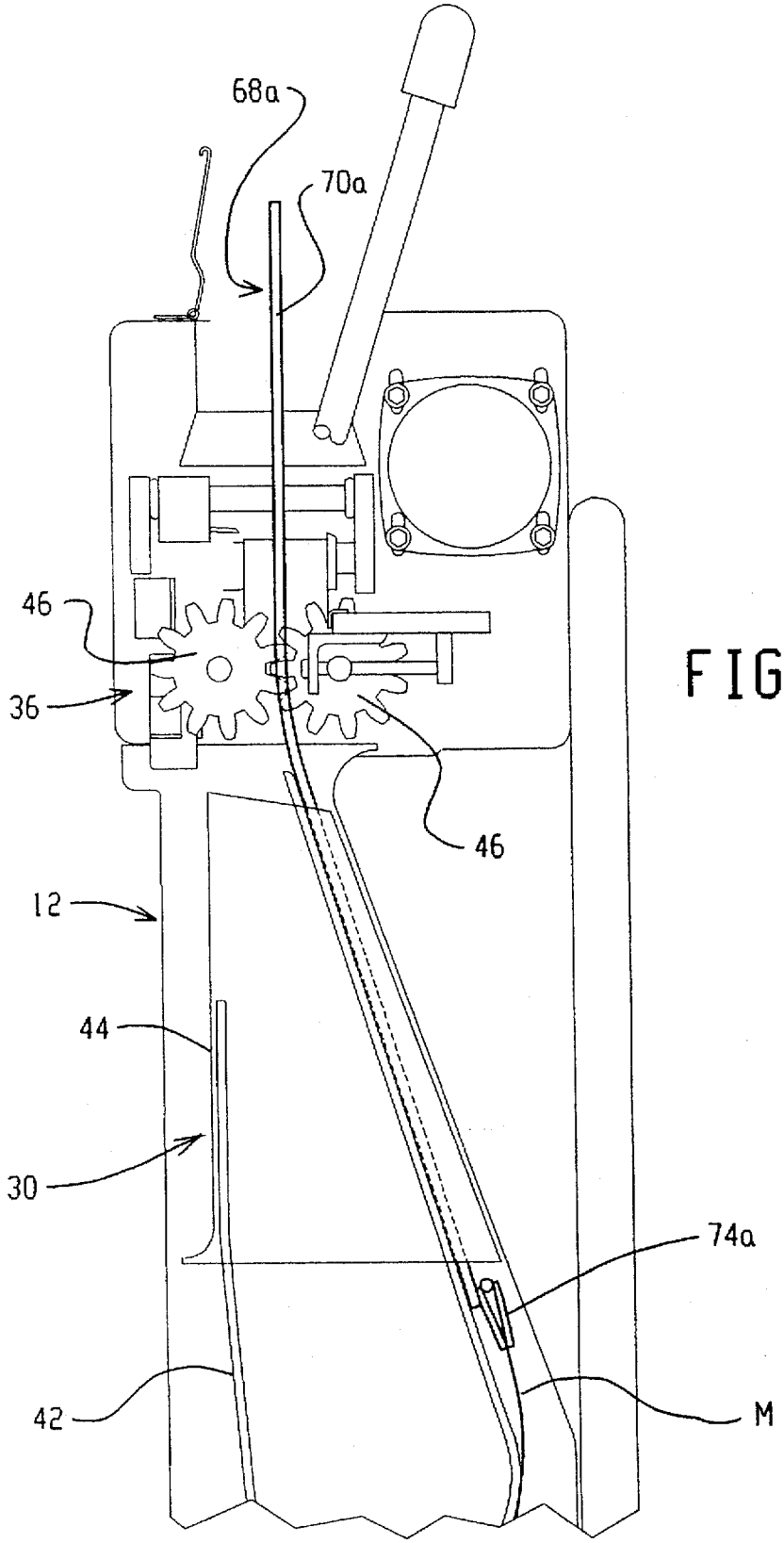

The threading member 70*a* may be used to load the machine 10 in the manner depicted in FIGS. 6–11 which provide sequential views of the loading process. If the machine is equipped with an interlock for the cover 64 (FIG. 2), the threading member 70 is aligned with and inserted into the outlet opening at the downstream end 16 of the machine until the clip end thereof is positioned for engagement by the gears. Rotation of the gears 46 in a direction opposite their normal feed direction (a reverse direction) advances the threading member reversely through the shaping chute 44. The gears are rotated long enough to position the clips 74*a* at the upstream end of the forming assembly 30 so that access may be had to the clips for attaching the leading end of the stock material M to the threading member as shown in FIGS. 8 and 9.

After the threading member 70 has been thus positioned in the machine, the plies $P_1$, $P_2$ of a multi-ply stock material M, such as a roll of multi-ply Kraft paper, are passed through the separators 62 and then brought back together and preferably folded into an arrow-shape, triangular-like fashion as shown in FIGS. 6 and 7. The folded leading end of the stock material is then positioned upstream of the forming assembly 30 and particularly the shaping chute 44 where it can be attached to the threading member by the attachment clips. (In FIGS. 6 and 7, the threading member 70 is shown outside the machine. Normally it would have been fed into the machine as aforedescribed prior to the stock material being folded into an arrow-shape. However, it will be appreciated that the stock material may first be prepared as shown with the cover open, then the cover closed and the threading member fed into the machine, and then the cover again removed to permit attachment of the stock material to the threading member.)

Figure 10:
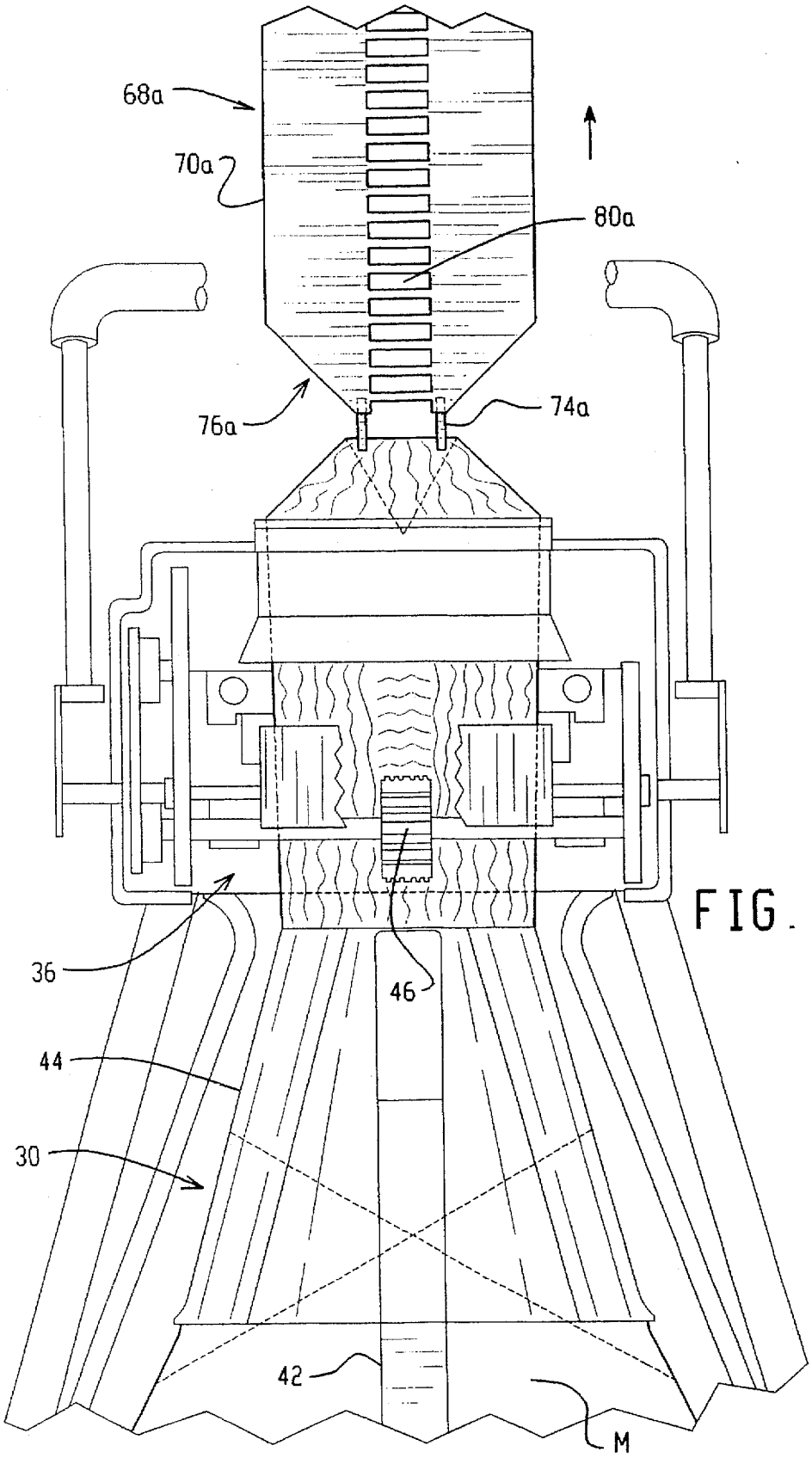
Figure 11:
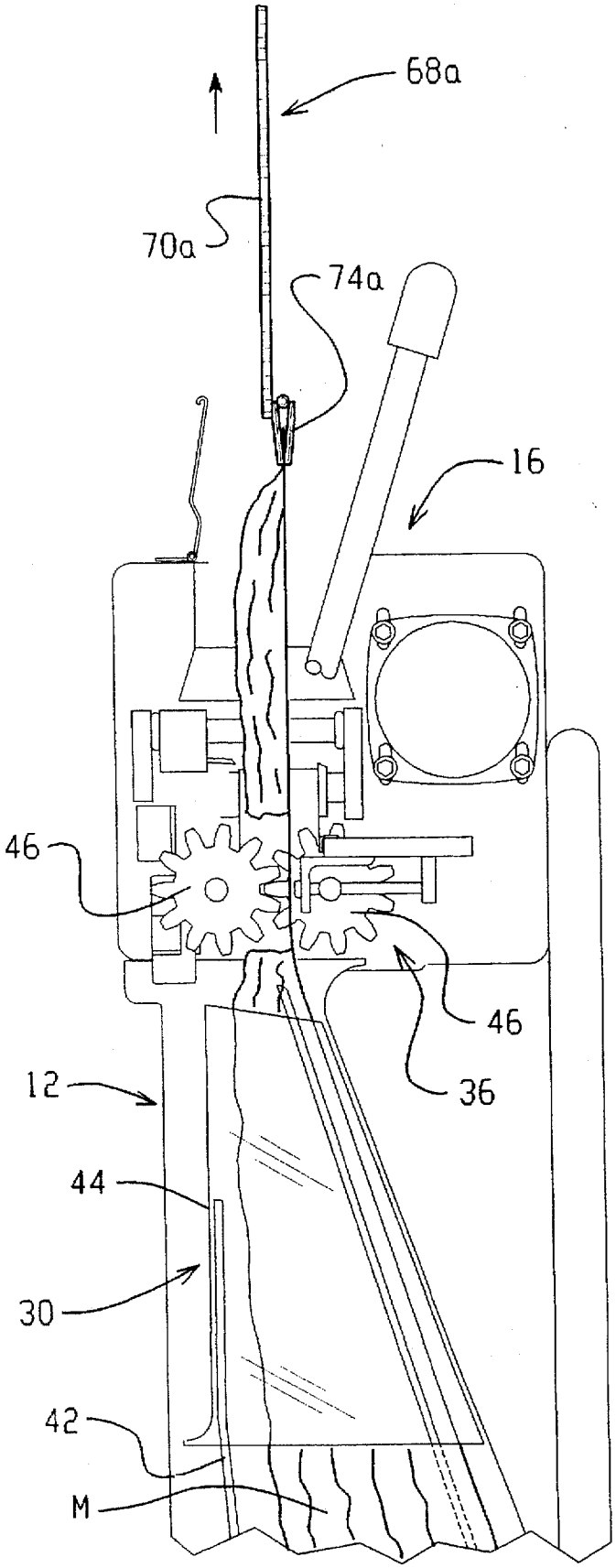

After the leading end of the stock material has been attached to the threading member and the cover 64 (FIG. 2) once secured in place to satisfy the interlock, the gears are rotated in their forward direction to advance the threading member forwardly until the clip end thereof emerges from the outlet opening at the downstream end 16 of the machine's housing 12 as shown in FIGS. 10 and 11. At this point the threading member is detached from the leading end of the stock material. With the stock material now threaded through the machine 10, the machine may now be operated to produce a dunnage strip.

If the machine 10 is loaded with stock material as just described, it will be appreciated that the row of slots 80*a* need only extend from the clip end 76*a* of the threading member 70*a* towards the handle end 78*a* of the threading member a distance about equal the distance between the gears 46 and the upstream end of the forming assembly 30 or more particularly the upstream end of the shaping chute 44. However, with the slots extending the full length of the threading member, the loading device 68*a* may be used in an alternative loading process. In this alternative process, the threading member 70*a* is aligned with and inserted into the upstream end of the forming assembly 30 and particularly the chute 44 thereof sufficiently to locate the handle end 78*a* of the threading member at the gears 46. Rotation of the gears in their forward direction advances the threading member forwardly and the gears are rotated long enough to position the clips 74*a* at the upstream end of the forming assembly for attachment of the leading end of the stock material to the threading member. After the leading end of the stock material has been attached to the threading member, the gears are again rotated in their forward direction to advance the threading member forwardly until the clip end thereof emerges from the outlet opening at the downstream end 16 of the machine's housing 12. At this point the threading member is detached from the leading end of the stock material. With the stock material now threaded through the machine, the machine may now be operated to produce a dunnage strip.

Reverting to FIG. 4, the threading member 70*b* of the loading device 68*b* has a single slot 80*b* of any desired shape extending longitudinally from the clip end 76*b* of the threading member towards but short of the opposite handle end 78*b* of the threading member. The slot 80*b* extends a distance about equal or greater than the distance between the gears 46 and the upstream end of the forming assembly 30 or more particularly the upstream end of the shaping chute 44 (FIGS. 1 and 2). Also, the slot has a width greater than the width of the gears 46 of the feeding/connecting assembly 32. Thus, the threading member can be inserted rearwardly into the machine 10 and past the gears which are accommodated by the slot (i.e., the threading member can be said to reach around the gears). Moreover, the loading device 68*b* can be used in a manner similar to that first described above with reference to FIGS. 6–11. However, it will be appreciated that the loading device must be manually advanced through the machine in both directions instead of being driven by the gears in the above described manner. Furthermore, the threading member must have an overall length sufficient to enable the handle end thereof to be grasped at the downstream end of the housing when the threading member is fully inserted into the machine for positioning of the clip end thereof at the upstream end of the forming assembly. Moreover, the loading device 68*b* can be inserted into the machine even with the cover 64 (FIG. 2) opened/removed, as it relies only on manual insertion.

With reference to FIG. 5, the loading device 68*c* is essentially the same as the loading device 68*a* (FIG. 3) except that the slots are in the form of recesses rather than holes in the threading member. Accordingly, the recesses 76*c* are preferably centered with respect to the longitudinal center axis of the threading member and are spaced apart at one half the pitch spacing of the teeth of the gears of the feeding/connecting assembly. Also, the recesses are dimensioned to receive the teeth of the gears therein when the threading member is fed between the gears and, in order to receive the teeth of both gears, alternating recesses open in opposite directions. Accordingly, the threading member 70*c* can be inserted into the feeding/connecting assembly 32 (FIGS. 1 and 2) and the gears 46 (FIGS. 1 and 2) rotated progressively to engage the teeth in the recesses for advancing the threading member in either direction depending on the rotation direction of the gears. Accordingly, the loading device 68*c* can be used in the same manner described above in connection with the loading device 68*a*.

Because the invention was conceived and developed for loading a cushioning conversion machine like that shown in FIGS. 1 and 2, and is particularly useful for such, it has been described herein chiefly in this context. However, the underlying principles of the invention could be adapted to other cushioning conversion machines with advantageous results, including machines which use, for example, different forming and/or feeding/connecting assemblies.

One may now appreciate that the present invention provides an improved device and method for loading a cushioning conversion machine. Although the invention has been shown and described with respect to certain preferred embodiments, equivalent alterations and modifications will no doubt occur to others skilled in the art upon reading and understanding this specification. The present invention includes all such equivalent alterations and modifications.

What is claimed is:

1. A device for loading sheet stock material from a supply thereof into a cushioning conversion machine for conversion of the stock material into a cushioning dunnage product, said loading device comprising:

an elongated threading member which passes through a stock material path of the cushioning conversion machine without interference, said threading member including a row of slots, including at least one slot extending from an attachment end of the threading member longitudinally along the threading member; and at least one attachment device at the attachment end of the threading member which attaches the stock material to the threading member.

2. A loading device as set forth in claim 1, wherein the threading member has a width dimension approximately equal to a width dimension of the dunnage product produced by the cushioning conversion machine.

3. A loading device as set forth in claim 1, wherein the threading member has a length dimension at least as long as a distance between an upstream end of a forming assembly in the cushioning conversion machine and a downstream end of a feeding/connecting assembly in the machine.

4. A loading device as set forth in claim 1, wherein the row of slots is a single slot open to the attachment end of the threading member, whereby the threading member is inserted around at least one pair of feeding gears in the cushioning conversion machine.

5. A loading device as set forth in claim 1, wherein the row of slots includes a plurality of longitudinally arranged slots, whereby the threading member can be fed between a pair of feeding gears in the cushioning conversion machine such that teeth of the gears extend into the slots for feeding the threading member without damaging the threading member.

6. A loading device as set forth in claim 5, wherein the threading member has a certain length and wherein the row of slots extends the length of the threading member.

7. A loading device as set forth in claim 5, wherein the slots are recesses thereby forming a row of recesses.

8. A loading device as set forth in claim 7, wherein the threading member has a certain length and wherein the row of recesses extends the length of the threading member.

9. A loading device as set forth in claim 1, wherein the attachment device includes two clips, each clip being equally spaced from a centerline extending parallel to a length dimension of the threading member.

10. A loading device as set forth in claim 1, wherein the threading member is made of a flexible material.

11. A method of loading sheet stock material into a cushioning conversion machine comprising the steps of:

attaching a leading end of the stock material to a loading device;

inserting the loading device into the cushioning conversion machine;

advancing the loading device through the machine sufficiently to thread the stock material in the machine without interference with the machine; and detaching the loading device from the stock material after such threading;

converting the stock material into a cushioning product by the machine after such detachment step.

12. A method as set forth in claim 11, wherein the attaching step precedes the inserting step.

13. A method as set forth in claim 11, wherein the inserting step precedes the attaching step.

14. A method as set forth in claim 11, wherein the loading device is inserted into the downstream end of the cushioning conversion machine.

15. A method as set forth in claim 11, further comprising the step of running the machine to advance the loading device through the machine.

16. A method as set forth in claim 11, wherein the attaching step includes the step of using a clip to attach the stock material to the loading device.

17. A method as set forth in claim 11, further comprising the step of supplying stock material that is biodegradable, recyclable and composed of a renewable resource.

18. A method as set forth in claim 17, wherein the stock material is composed of multiple plies.

19. A cushioning conversion machine for converting sheet stock material into a three-dimensional cushioning dunnage product, and a loading device, said machine comprising a forming assembly including a shaping chute which shapes the stock material; and a feeding/connecting assembly including at least one rotating feed element which feeds the stock material through the machine;

said loading device including an attachment device at an upstream attachment end thereof which attaches the stock material to the loading device for passage through said feeding/connecting assembly without interference.

20. A machine as set forth in claim 19, wherein said loading device has a width dimension approximately equal to a width of the dunnage product produced by the machine and a length dimension at least as long as a distance between an upstream end of the shaping chute and a downstream side of the rotating feed element of the feeding/connecting assembly.

21. A device for loading stock material from a supply thereof into a cushioning conversion machine for conversion of the stock material into a cushioning dunnage product, said loading device comprising:

an elongated threading member including means for passing through a stock material path of the cushioning conversion machine without interference; and attachment means at an upstream attachment end of the threading member for attaching the stock material to the threading member.

* * * * *